US008182376B2

(12) United States Patent
Kotula

(10) Patent No.: US 8,182,376 B2
(45) Date of Patent: May 22, 2012

(54) ADJUSTABLE WEIGHTED FIELD HOCKEY STICK

(75) Inventor: Joanna Kotula, Baltimore, MD (US)

(73) Assignee: Wm. T. Burnett IP, LLP, Baltimore, MD (US)

( * ) Notice: Subject to any disclaimer, the term of this patent is extended or adjusted under 35 U.S.C. 154(b) by 297 days.

(21) Appl. No.: 12/586,353

(22) Filed: Sep. 21, 2009

(65) Prior Publication Data

US 2010/0087281 A1 Apr. 8, 2010

Related U.S. Application Data

(60) Provisional application No. 61/192,588, filed on Sep. 19, 2008.

(51) Int. Cl.
*A63B 59/12* (2006.01)

(52) U.S. Cl. ..... 473/519; 473/560

(58) Field of Classification Search ..... 473/519, 473/520, 437, 560–563, 334, 345
See application file for complete search history.

(56) References Cited

U.S. PATENT DOCUMENTS

| | | | | |
|---|---|---|---|---|
| 2,652,256 | A * | 9/1953 | Thomas | 473/333 |
| 4,179,121 | A * | 12/1979 | Kelmanski | 473/519 |
| 4,427,195 | A * | 1/1984 | Hufenus | 473/519 |
| 4,491,320 | A * | 1/1985 | Smith | 473/446 |
| 4,858,928 | A * | 8/1989 | Muroi et al. | 473/519 |
| 5,054,780 | A * | 10/1991 | Chen | 473/519 |
| 6,599,201 | B1 * | 7/2003 | Grant | 473/256 |
| 6,939,273 | B2 * | 9/2005 | Zajac et al. | 482/93 |
| 7,166,041 | B2 * | 1/2007 | Evans | 473/334 |
| 2004/0259666 | A1 * | 12/2004 | Bjugstad et al. | 473/437 |
| 2005/0070382 | A1 * | 3/2005 | Loschiavo | 473/563 |
| 2005/0137024 | A1 * | 6/2005 | Stites et al. | 473/291 |
| 2006/0122004 | A1 * | 6/2006 | Chen et al. | 473/335 |
| 2006/0240908 | A1 * | 10/2006 | Adams et al. | 473/334 |
| 2010/0022326 | A1 * | 1/2010 | McClung et al. | 473/333 |
| 2010/0075773 | A1 * | 3/2010 | Casati, Jr. | 473/334 |

* cited by examiner

*Primary Examiner* — Mark Graham
(74) *Attorney, Agent, or Firm* — Ober, Kaler, Grimes & Shriver; Royal W. Craig

(57) ABSTRACT

A weighting system for a sports stick, particularly a field hockey stick, comprising a surface, recess, channel, hole or plurality of pockets formed along the length of the sports stick, and one or more weights moveably or selectively attachable along the surface and/or within the channel/pockets to allow a player to freely adjust the weight and balance point of the stick by slideably moving to or selectively adding or eliminating weight and points along the stick. A variety of embodiments are herein described, all providing an adjustable field hockey stick that allows players to adapt to play on different surfaces or in different conditions.

4 Claims, 20 Drawing Sheets

ADJUSTABLE WEIGHTED FIELD HOCKEY STICK

CROSS-REFERENCE TO RELATED APPLICATIONS

The present application derives priority from provisional application 61/192,588 filed on Sep. 19, 2008 which is incorporated herein by reference.

BACKGROUND OF THE INVENTION

1. Field of the Invention

The present invention relates generally to field hockey and, more specifically, to a field hockey stick with integral weighting system to allow a player to adjust the weight and balance of the stick.

2. Description of the Background

Traditionally, sports sticks, and in particular, field hockey sticks have been constructed of relatively standard dimensions, due primarily to widely accepted rules of the game. These rules dictate aspects of the stick such as weight, length, shape, and cross section. As one example, the playing rules require that the ball contact portion of the stick have a flat face and that every cross section of the stick be able to pass through a fifty-one millimeter ring. To comply with these rules, the traditional field hockey stick has a curved head or "toe" with a flat front face and curved back portion of relatively uniform shape. The total weight of a field hockey stick as defined by widely accepted rules (e.g., The International Hockey Federation's Rules of Hockey) must not exceed 737 grams. Within these parameters, field hockey sticks have had a traditional shape and weight disbursement. To date, balance points and weight differences have only been dictated by the manufacturer during the design and manufacturing process, and end-users/players have no capability for self-adjustment. While the present application is drafted with reference to field hockey sticks, the invention is not limited to such sports sticks and equipment and the sticks of other sports are incorporated into the definition of the same, as determined by the rules of such other sports including, without limitation, ice hockey, roller hockey, street hockey and cricket.

Field hockey sticks are typically made of wood (usually mulberry) or composites. Sticks made with composites usually contain a combination of fiberglass, aramid fiber and/or carbon fiber impregnated with a polymer resin, or other combinations of a matrix material and reinforcement material, in varying proportions according to the desired flexibility and resistance to impact and abrasion. Composite field hockey sticks are typically made by laying up layers of material around a bladder. Bladder molding processes sometimes use an air bladder, a two-part female mold, composite material, and resin. The bladder is inflated, thus creating pressure to force the matrix material and resin against the mold until it cures, thereby forming a hollow field hockey stick. In laying up composites, sheets of uncured fiber-reinforced thermosetting resin are also sometimes wrapped around a mandrel that is expanded by forced air either before or after the mandrel is withdrawn to form a hollow tubular lay-up. Using either method, traditional, hollow composite field hockey sticks generally have constant wall thicknesses and a predetermined overall weight.

For example, U.S. patent application Ser. No. 11/501,708 in the name of Richard B. C. Tucker, Sr., incorporated herein by reference, teaches a back and edge portion construction of a composite stick for the purpose of redistributing weight to more desirable locations for improved playability. The overall weight and balance point are determined by how much, how little, and/or where material is laid up. For example, additional material can be laid up in predetermined spots along the stick's length or in the toe section to create a certain weight, balance point, and feel for the player. Once the stick is molded, however, the weight, balance point, and feel are permanent. Examples of the materials used in the resin include fiberglass, carbon, and aramid fibers.

Composite sticks have been available on the market and approved for international play for several years. It is widely believed that composite sticks generate more power than wood sticks. Composite stick manufacturing techniques allow the manufacturer to specify and control weights and balance points far better and more effectively than wood stick manufacturing processes, which consist primarily of shaping mulberry tree wood into a desired shape and then treating and wrapping the solid wood. Because of the vagaries of natural wood, there is little opportunity for wood stick manufacturers to add balancing features. Different weights and balance points affect the playability of the stick, however, and produce different results. For example, a stick with more weight in the toe or head of the stick feels heavier to the player due to a lower balance point and, because of the increased lower mass, can produce a more powerful drive than a stick of equal weight but with a higher balance point, i.e., a stick that is weighted further from the toe section.

It is invariably the personal preference of the player that determines the optimal weight and balance point for their style of play or their own physical characteristics. There are a variety of reasons why a player might want to adjust the weighting including the field surface (artificial turf versus natural grass), weather conditions, demands of the player's position and the tendencies of a particular opponent. Each surface requires a different set of skills and maneuvers. For example, players must stand taller and swing the stick harder on grass to accommodate for the slower, unpredictable surface. Therefore a stick that is heavier and provides more mass near the toe section is typically preferred for grass play. By contrast, synthetic turf is more level and creates less obstruction to a rolling or bouncing ball, or the stick itself. Thus, players typically play closer to the ground (bent over), do not have to swing as hard to move the ball a desired distance, and are able to perform different stick maneuvers, such as sweep hits (hits off the front or back edge section of the stick lying nearly flat on the playing surface) and drag flicks (ball travels down the entire length of the stick lying nearly flat on the playing surface, whipping off the end towards a desired target), which the height and inconsistency of a natural surface can impede. Therefore, a stick that is lighter and balanced higher (further from the toe section) is often preferred for artificial turf play.

Varying playing surfaces and conditions thus call for differently weighted sticks. Many players have occasion to play on both grass and artificial turf in the same season, such that playing surfaces often vary from game to game and may even vary during a game (for example in adverse weather conditions). However, once a conventional stick (wood or composite) is chosen the player cannot meaningfully alter the weight and balance point but rather are constrained to a stick that meets manufacturer-determined criteria, even if they buy multiple sticks that are weight balanced differently.

As a partial solution, players have traditionally added various types of tape to the external surfaces of the stick including athletic tape, lead tape, and waterproof tape, primarily to either enhance gripping or to stave off wear and tear (from a frequently hit hard plastic ball or stick-to-stick contact). Tape's effectiveness is limited in as much is it is not permanent and has a tendency to fall off or lose its tackiness under the stress of practice and game conditions resulting in altered stick feel and performance. Wrapped tape also adds bulk to the stick cross section and can render the stick illegal if it can no longer pass through a fifty-one millimeter ring as a result. Thus, player-added tape is an ad hoc and ineffective solution at best.

It would thus be desirable to provide a field hockey stick designed and manufactured to allow a player to precisely and reliably adjust the weight and balance point of the stick, thereby allowing players to adapt to play on different surfaces or in different conditions, and to better accommodate the vast number of player preferences.

Adjustably-weighted sports devices are known in other contexts. For example, U.S. Pat. No. 6,432,004 to Nemeckay issued Aug. 13, 2002, and U.S. Pat. No. 6,159,115 to Hsu issued Dec. 12, 2000 show adjustably-weighted tennis rackets, while U.S. Pat. No. 6,015,354 to Alm et al. issued Jan. 18, 2000 and U.S. Pat. No. 5,518,243 to Redman issued May 21, 1996 show adjustably-weighted golf clubs. However, a weighted field hockey stick would combine a stick frame, weight carrier, and weight(s), all of working together under arduous conditions. Material selection becomes very important, and the present invention is also designed and manufactured with these interrelated material selection issues in mind.

SUMMARY OF THE INVENTION

It is, therefore, the primary object of the present invention to provide a field hockey stick with an integral weighting system to allow a player to precisely and reliably adjust the weight and balance point of the stick to adapt to playing conditions on different surfaces and situations, and to do so within the parameters for stick design imposed by the governing bodies of the sport.

This and other objects are accomplished by a weighting system for a sports stick, particularly a field hockey stick, having one or more surfaces or recesses formed within the head and/or handle of the sports stick with a plurality of weights selectively locatable and relocatable within the recess(es) or along the surfaces to allow a player to freely adjust the weight and balance point of the stick to preference. A variety of embodiments are herein described.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is an integral weighting system for a field hockey stick that allows a player to adjust the weight and balance point of the stick, thereby allowing players to adapt the stick to suit personal preference with regard to play on different surfaces or in different conditions.

Figure 1:
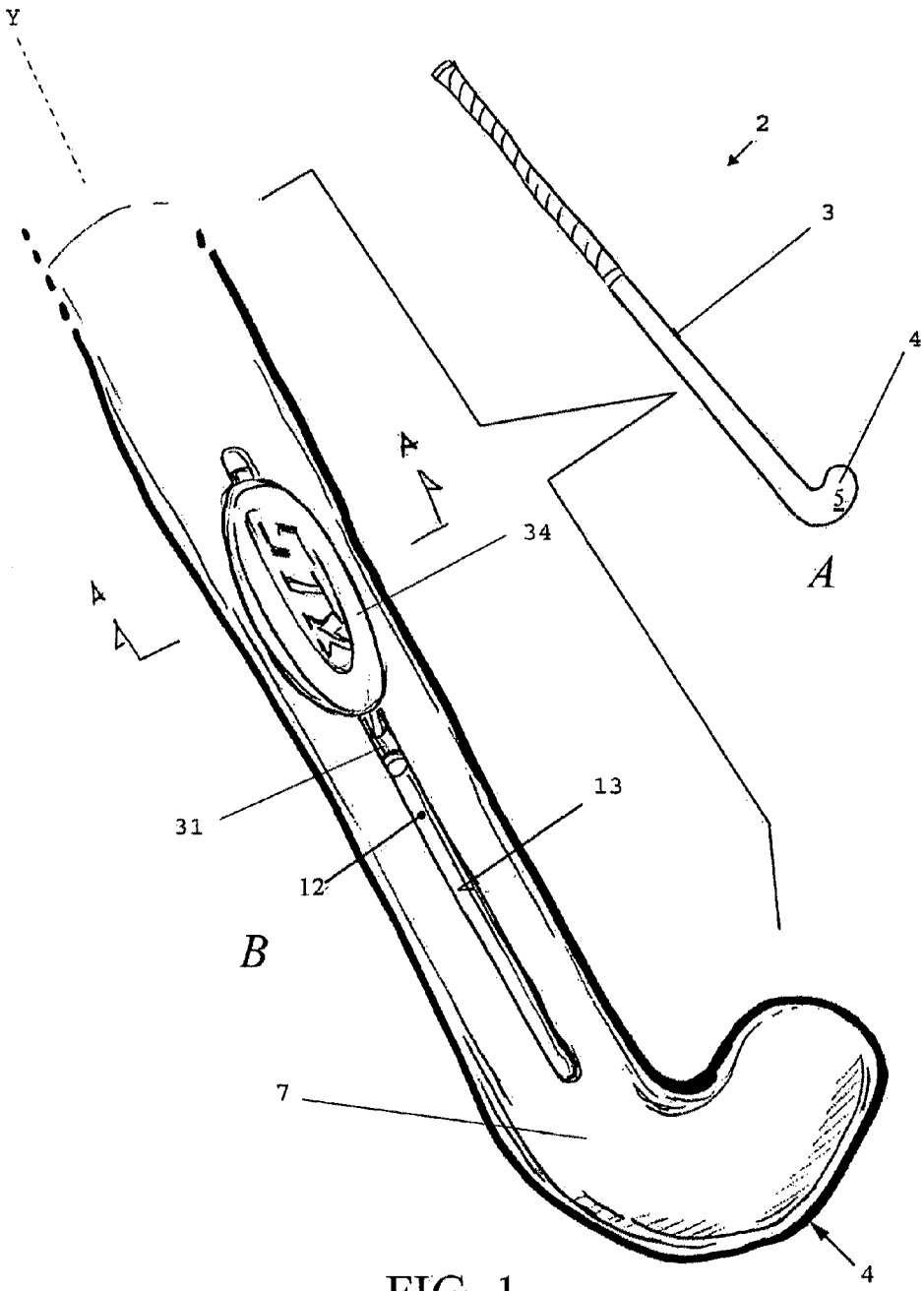
FIGS. 1 (A & B) is a perspective composite view of a field hockey stick with integral weighting system according to a preferred embodiment of the present invention, from the rear.

FIG. 1 is a composite perspective view of a field hockey stick 2 with integral weighting system according to a preferred embodiment of the present invention, from the front side (at A) and rear (B). The field hockey stick 2 has a generally linear handle 3 and conventional curved head 4. The handle portion has a primary longitudinal axis Y and is characterized by a flat face 5 for striking a ball and a curved back face 7 that is not intended for ball striking. The field hockey stick 2 is depicted in keeping with the generally traditional form of such sticks although any stick having these characteristic elements and meeting the rules or limitations of a governing body is acceptable. The field hockey stick 2 is constructed of wood or composite material although composite material construction is preferred. It should be observed that the term "ball" as used herein is not limited to spherical forms and is defined to include any of various rounded, movable objects used in various athletic activities and games such as, without limitation, balls, pucks and shuttlecocks, etc.

A "C" shaped channel 12 is provided in the handle 3 of the stick 2 and may extend up the handle as far as desired without interfering with the player's grip of the handle at the distal end. Channel 12 is preferable approximately 250 mm in length and may extend to all or part of the head 4. Alternately a second channel of similar design may be provided in the head portion. Channel 12 is parallel to longitudinal axis Y (except in as much as it extends into the curved head) and may be concentric with axis Y or offset there from. Channel 12 is open to the back face 7 of stick 2 at slot 13.

Figure 2:
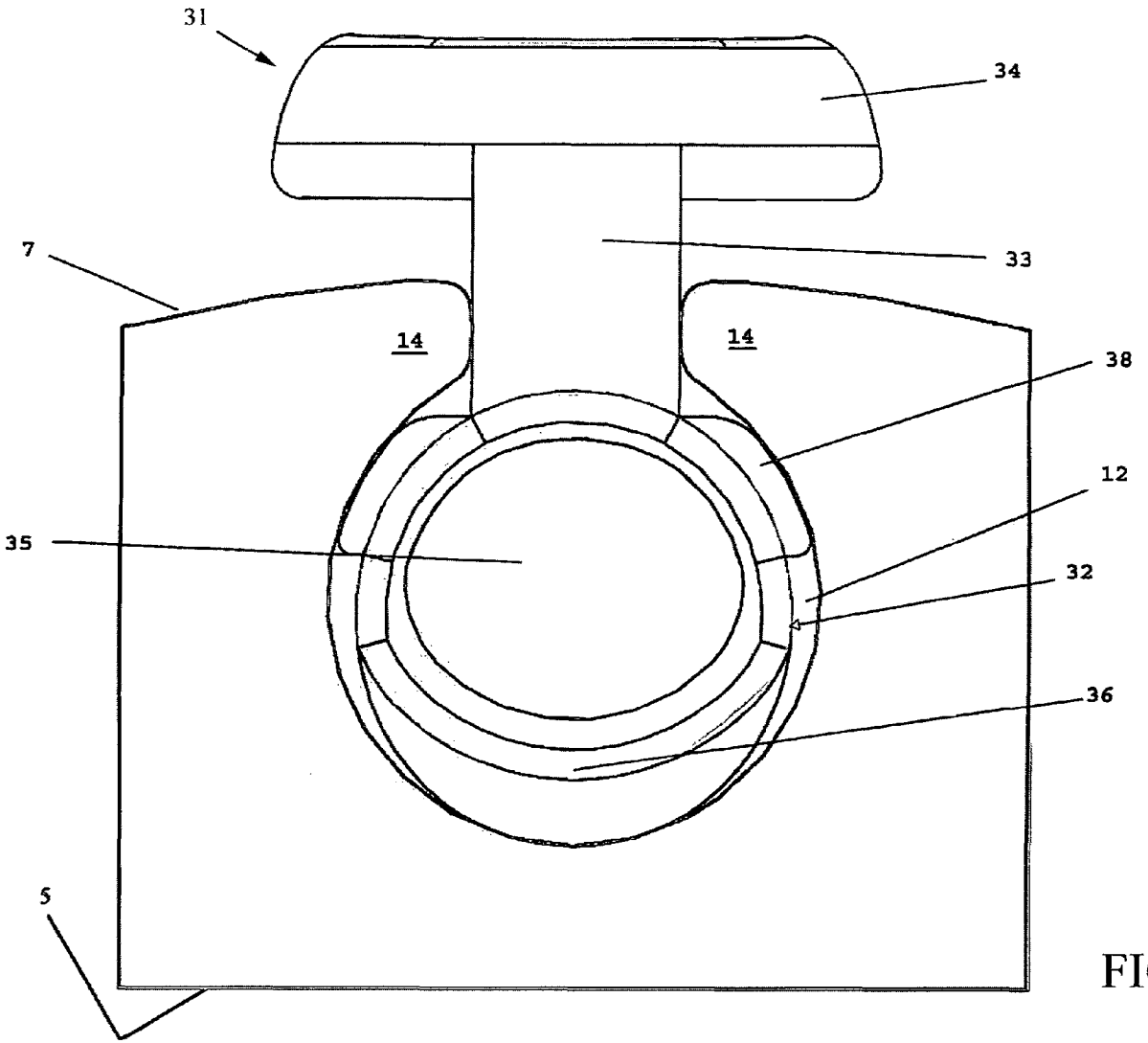
FIG. 2 is a partial view of the field hockey stick of FIG. 1 along section A-A of FIG. 1(B).

FIG. 2 is a partial view of the field hockey stick of FIG. 1 along section A-A of FIG. 1(B). It can be seen that slot 13 is formed between lips 14 overhanging either side of the channel 12. The cross section of Channel 12 along with lip 14 defines an enclosed convex form that preferably has a generally "C" or circular shape, although oval, elliptical and rectilinear cross sections are in keeping with the spirit of the invention.

Figure 3B:
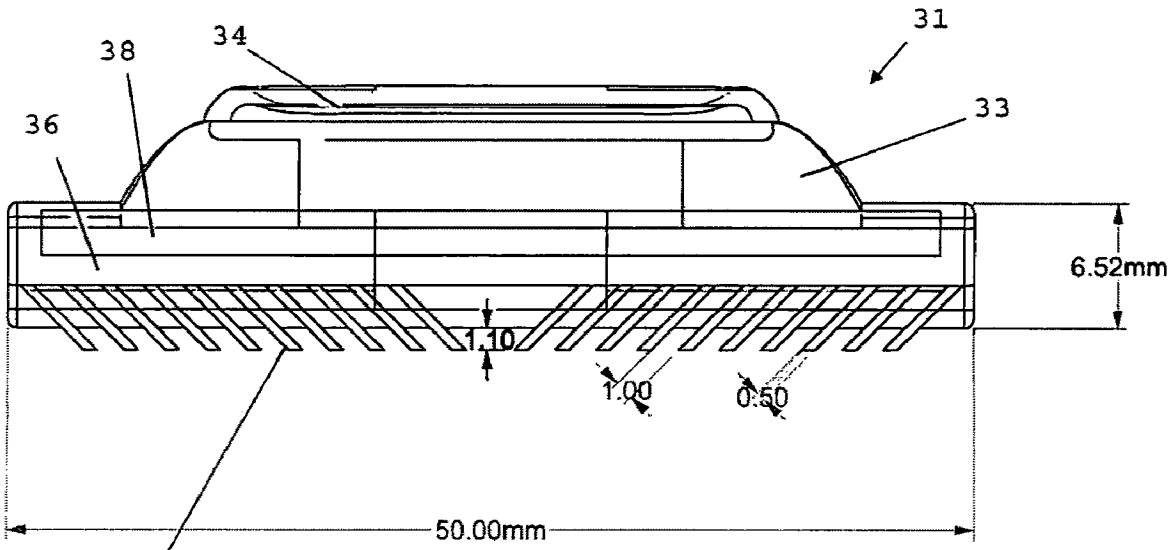
FIG. 3B is a side elevation of a weight car according to a preferred embodiment of the present invention.
Figure 3A:
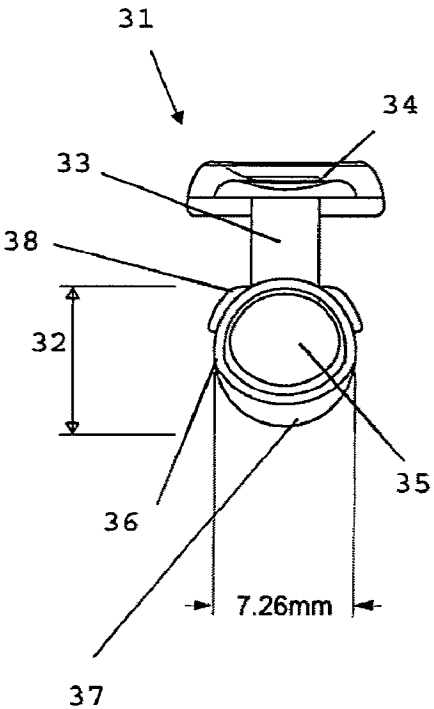
FIG. 3A is an end elevation of a weight car according to a preferred embodiment of the present invention.

With combined reference to FIGS. 2, 3A and 3B, a weight car 31 has a body 32 that resides in channel 12 and a dorsal member 33 that protrudes from the body through slot 13 to a slide grip 34. Dorsal member 33 may be a strut, fin, rod or any form suitable for joining the body 32 to slide grip 34. Body 32 has a cross section conforming to that of channel 12 but slightly smaller and with a diminished height dimension for selective sliding within the channel 12 as described below. Body 32 is thus depicted as generally ovoid in cross section. The body 32 is preferably approximately 50 mm in length but may be shorter or longer as required or desired and is characterized by a high density core 35 extending substantially its entire length. The high density core 35 is preferably made from a high density thermoplastic or other high density polymer such as high density polyethylene (HDPE) or the like.

High Density core 35 may be surrounded by a shell 36 to provide the weight car 31 with its ultimate shape. The shell 36 is formed on its lower surface with one or more resilient projections 37 that conform to the bottom surface of channel 12 and are elastically deformable by compression or bending. As depicted in FIGS. 3A and 3B, projections 37 may be arranged as a series of ribs that extend from the shell 36 at opposing angles such that the lateral force component of the two banks due to bending cancel each other under operative conditions as described below. Alternately, a single bank of ribs or other resilient projections can be employed which may be in the form of bristles, bumps, knobs, protrusions or other prominences. The projections 37 are capable of deforming and are collectively reducible in volume under application of compressive stress, but resume their original shape and/or volume upon removal of the applied compressive stress. The shell 36 and projections 37 may be integrally constructed of suitable polymeric compounds such as thermoplastic polyurethane elastomer. Alternatively, separate projections 37 may be embedded in shell 36.

As best seen in FIG. 2, the top surface of the shell 36 is provided on either side by a longitudinal protrusion 38 of high friction material formed to cooperatively engage the surface of lips 14 inside channel 12. Suitable high friction materials include rubber compounds, ceramic, urethane or textured materials, or any other materials that present a relatively high coefficient of friction relative to the walls of channel 12 to thereby prevent sliding. The dorsal member 33 is positioned between the opposing longitudinal protrusions 38 and extends upward from the body 32 through slot 13 where it is broadened to form slide grip 34.

In use, car 31 is engaged within the channel 12 of the stick 2. The resilient projections 37 engage the bottom of channel 12 to force body 32 upward (relative to the channel bottom as depicted in FIG. 2) such that the high friction longitudinal protrusions 38 engage the lips 14 within channel 12 thereby preventing the car 31 and the contained high density core 35 from sliding within the channel during use of the stick in play. When a player determines that an adjustment of the stick's weight distribution is necessary, the slide grip 34 is pressed against the back surface 7 of the stick 2 forcing the body 32 toward the bottom of the channel via the dorsal member 33 and thereby bending or, as the case may be, compressing, the resilient projections 37. Bending of the projections 37 (ribs) and movement of body 32 toward the bottom of channel 12 disengages the high friction longitudinal protrusions 38 from the surface of the lips 14 within the channel 12 thereby permitting the car 31 to slide within the channel 12 under control of the slide grip 34. Interaction of the relatively hard surfaces of the body 32, channel 12 bottom, underside of the slide grip 34 and back surface 7 of the stick 2 offer relatively low friction and thus low resistance to sliding of the weight car 31. When the player has positioned the weight car 31 as desired the slide grip 34 is released. The resilient projections 37 then again force the body 32 upward within the channel re-engaging the high friction longitudinal protrusions 38 with the lips 14 within channel 12 to again prevent the car 31 and the contained high density core 35 from sliding. Multiple weight cars 31 may be provided in the channel 12 for additional versatility.

Figure 4:
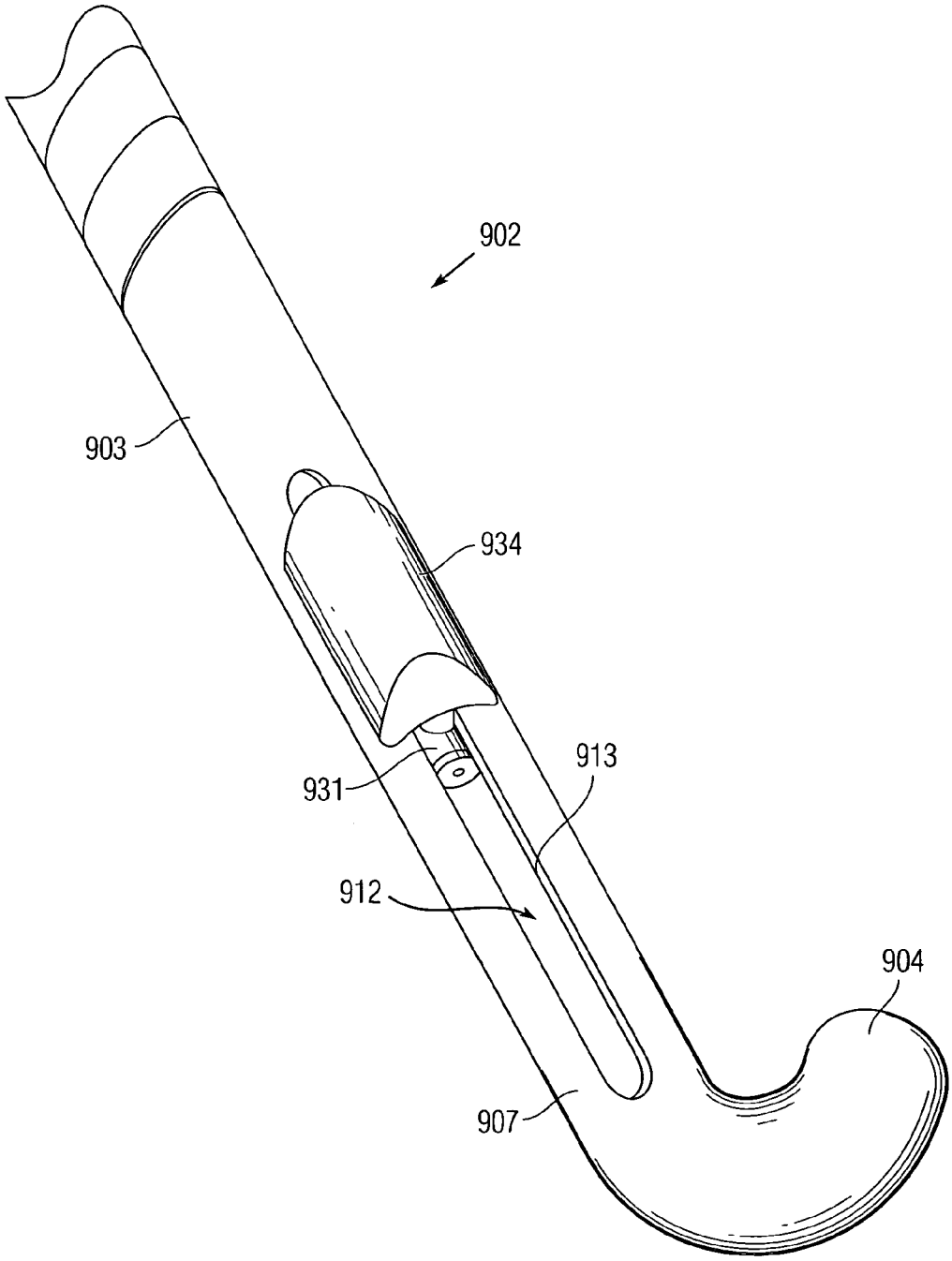
FIG. 4 is a partial perspective view of a field hockey stick with integral weighting system according to a second embodiment of the present invention.

In an alternate embodiment, depicted in FIG. 4, a field hockey stick 902 of similar design to that previously described has a generally linear handle 903 and curved head 904. The handle portion has a primary longitudinal axis Y and is characterized by a flat face 905 for striking a ball and a curved back face 907 that is not intended for ball striking. The field hockey stick 902 is constructed of wood or composite material although composite material construction is preferred. A "C" shaped channel 912 is similarly provided in the handle 903 of the stick 902 and again may extend up the handle as far as desired and may extend to all or part of the head 904. As above, channel 912 is open to the back face 907 of stick 902 at slot 913 which is formed between a lip 914 overhanging either side of the channel 912. The cross section of Channel 912 along with lip 914 again defines a generally enclosed convex form that is depicted to have a generally circular shape which is preferable, although oval, elliptical and rectilinear cross sections are in keeping with the spirit of the invention.

Figure 5A:
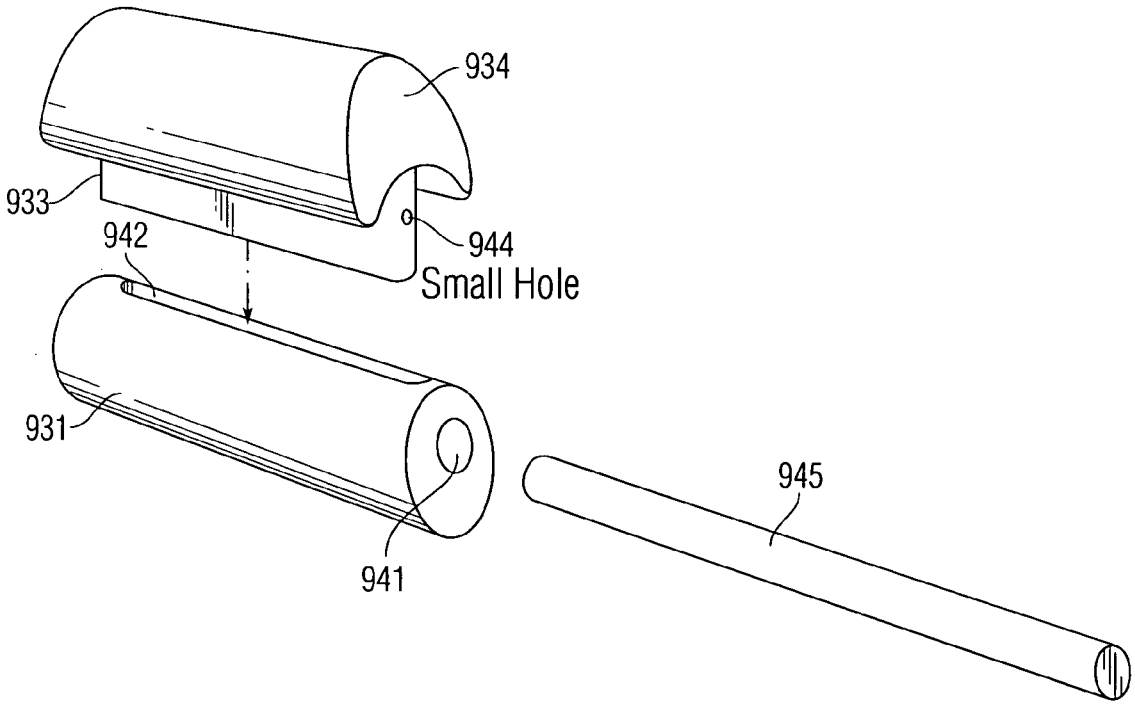
FIGS. 5A-5C are exploded assembly views of a weight car of the integral weighting system according to the second embodiment of the present invention.
Figure 5B:
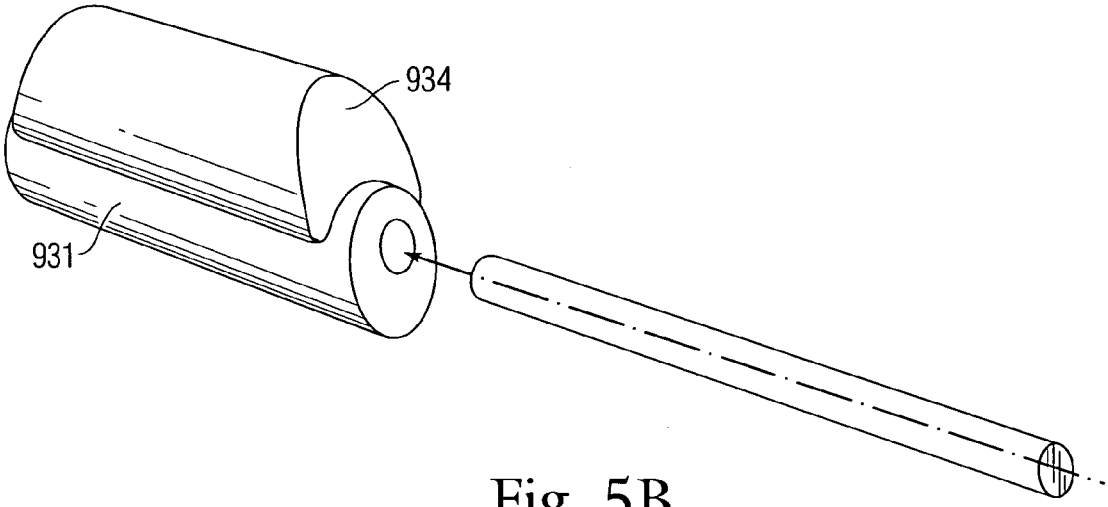
Figure 5C:
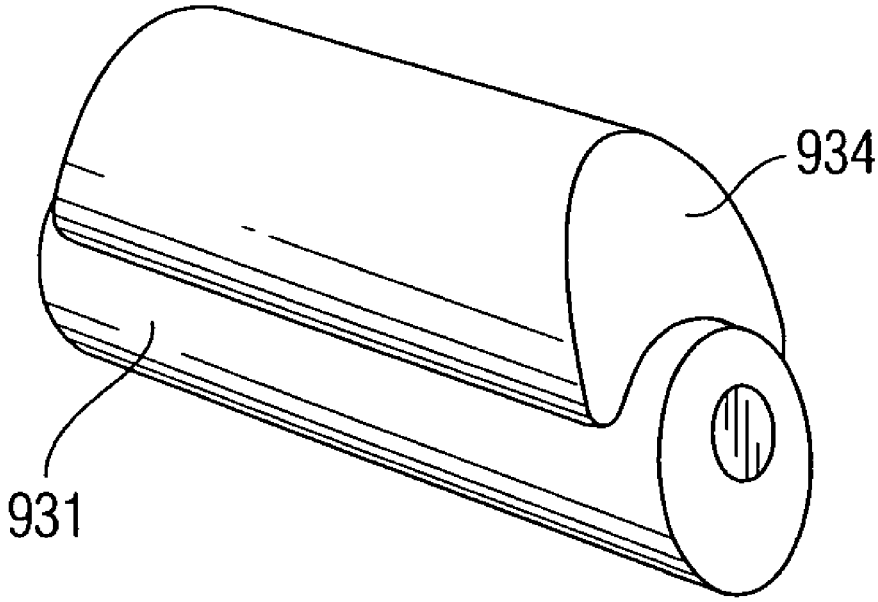

With reference to FIGS. 5A though 5C, a weight car 931 having a cross section matching but slightly smaller than that of the channel 912 is situated within the channel. The weight car 931 is preferable made from a high density thermoplastic or other high density polymer. Tolerances between the channel side walls/top/bottom and the weight car 931 are quite small and are intended to permit sliding of the core within the channel on the longitudinal axis while substantially eliminating movement on any other axis. The weight car 931 is joined to a grip 934 by a strut 933. The grip 934 may be formed of a resilient, high friction material such as silicone rubber or other elastomer. The strut 933 is similarly preferably constructed of a resilient material and may be molded as a single unit along with the grip 934 or may be joined to the grip 934.

The strut 933 is preferably a single planar form but may be comprised of multiple shorter planar forms, dowels, blocks, rods or any other forms suitable for resiliently joining the grip 934 to the weight car 931. Further, the strut 933 may be joined to the weight car 931 in any known manner including by adhesive, mechanical connectors, welding, etc. In a preferred embodiment a central, longitudinal aperture 941 is provided within the weight car 931 that joins a slot 942 through the top of the central portion of the weight car 931. A longitudinal aperture 944 is also provided in the strut 933. Strut 933 is inserted into the slot 942 so that the longitudinal apertures 941, 944 are aligned at which point a pin 945 may be inserted to capture the strut 933 within the slot 942 and thereby join the weight car 931 and grip 934 via strut 933.

In use, weight car 931 is engaged within the channel 912 of the stick 902. The resilient strut 933 extends through the slot 913 and joins the grip 934 at the back face 907 of the stick 902. Resilient strut 933 is in tension such that the weight car is drawn upward against the lips 914 on either side of the slot 913 and high friction grip 934 is normally drawn downward into contact with the curved back face 907 of the stick 902. The bottom surface of the grip 934 is formed to cooperatively engage the curved back face 907 to maximize contact area. Engagement of the high friction grip 934 with the back face 907 prevents the weight car 931 from sliding within the channel 912 during use of the stick in play. When a player determines that an adjustment of the stick's weight distribution is necessary, the slide grip 934 is lifted away from the back surface 907 of the stick 902 by stretching the resilient strut 933. With the high friction grip 934 disengaged from the back surface 907 the car 931 is permitted to slide within the channel 912 under control of the slide grip 934. Interaction of the relatively hard surfaces of the weight car 931 and lips 914, offers relatively low friction and thus low resistance to sliding of the weight car 931 within the channel. When the player has positioned the weight car 931 as desired the grip 934 is released and the resilient strut again draws the high friction grip 934 down to re-engage against the back surface 907 prevent the car 931 from sliding. As above, multiple weight cars 931 may be provided in the channel 912 for additional versatility.

With reference to FIGS. 6A through 6E, in yet another embodiment of the present invention a composite stick is manufactured with a recessed channel or pocket approximately 250 mm in length along the back or non-hitting side of the stick 2. As seen in the cross-sections shown in FIG. 6C, the composite stick 2 may be manufactured with hollow tubular walls 3 with a central reinforcing partition 6A (top) and the recessed channel 10 formed on one side of the partition 6A, or the composite stick walls 3 may be manufactured with the recessed channel 10 formed centrally and connecting to a central reinforcing rib 6B (middle). A flexible weight tray 20 is provided for insertion into the channel 10. Tray 20 is preferably formed of material of lower durometer hardness than the composite walls 3, such as for example injected molded rubber, thermoplastic polyurethane elastomer (TPU) or other suitable malleable material. The flexible weight tray 20 is designed for secure placement within the recessed channel 10 by friction and/or tongue-and-groove fit, and may be secured endwise by inwardly-protruding necking or dovetailing 22 of the each end of the channel 10. Slight stretching of the tray 20 between the dovetails 22 increases the holding force retaining the tray 20 in the channel 10. The interior of the flexible weight tray 20 is formed with a plurality of receptacles 30 each designed to receive one or more weights 40 that can be inserted or removed into the receptacles 30 at various points along the tray's length. The weights 40 may, in a preferred embodiment, be cylindrical, made of high density polymer material, weigh approximately ten (10) grams each, and be sized for a friction fit within the receptacles 30 at any desired point along the tray 20. One skilled in the art will readily understand that other attachment means, including posts, can alternatively be used. The weight tray 20 may further be formed with outwardly-facing apertures that serve as windows into each receptacle 30 to allow a player to quickly and externally view exactly where weights 40 are inserted along the tray's length when the stick is fully assembled.

Given the difficult play conditions under which the foregoing composite stick 2, flexible weight tray 20, and weight(s) 40 must function, material selection becomes very important. As a general parameter, a lower relatively durometer hardness weight tray 20 is desirable for use with high density weight(s) 40 for seating and constraining the weight(s) 40. The weight tray 20 should be constructed of a material having a lower durometer hardness than that of the stick 2 composite for proper fit and retention. The present invention contemplates these relative material selection attributes. The weights 40 can be any shape or weight, and may be injection molded from a variety of materials, most preferably high density TPU or other dense plastic.

Figure 6A:
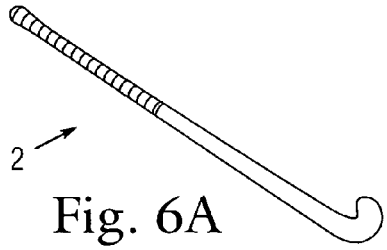
FIGS. 6A-6E is a perspective composite view of a field hockey stick with integral weighting system according to a third embodiment of the present invention.
Figure 6B:
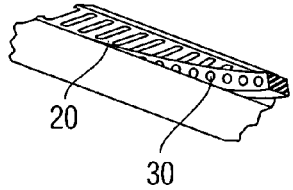
Figure 6C:
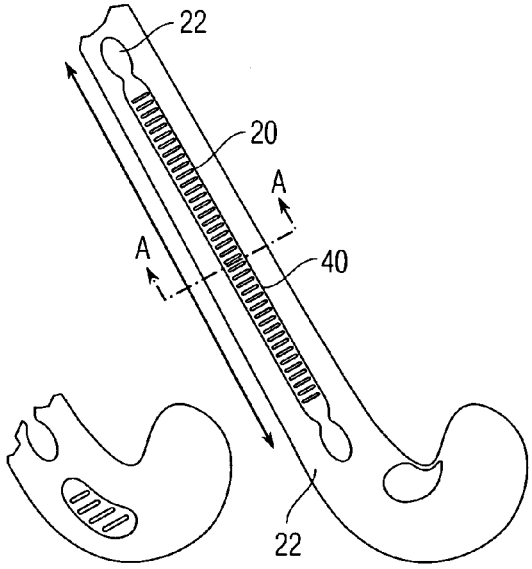
Figure 6D:
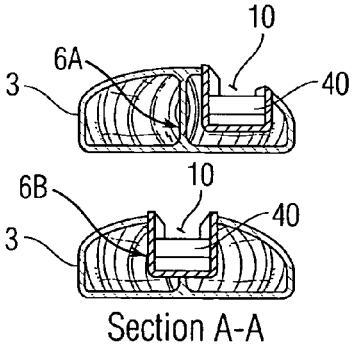
Figure 6E:
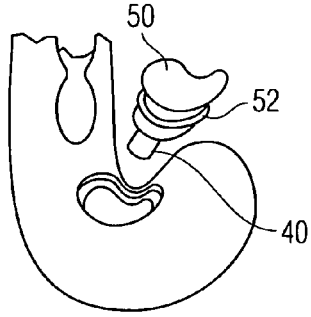

If desired, additional weight trays may be provided separate and apart from tray 20. For example, as seen In FIG. 6E, a distal weight tray 50 may be insertable into a recess or pocket in the toe of the stick to add weight thereto. In this case, it is preferable that the toe weight tray 50 be located in a non-contact position on the toe so as not to interfere with ball contact and be provided in a curvilinear form with an outwardly facing contoured surface conforming to the curve of the stick. As illustrated, the distal weight tray 50 may be formed as a cylindrical or irregular plug insertable into the pocket and held captive therein by an annular rib 52. One or more cylindrical weights 40 as above can be inserted into the toe weight tray 50, which in turn is inserted into the recess to add weight thereto.

Figure 7:
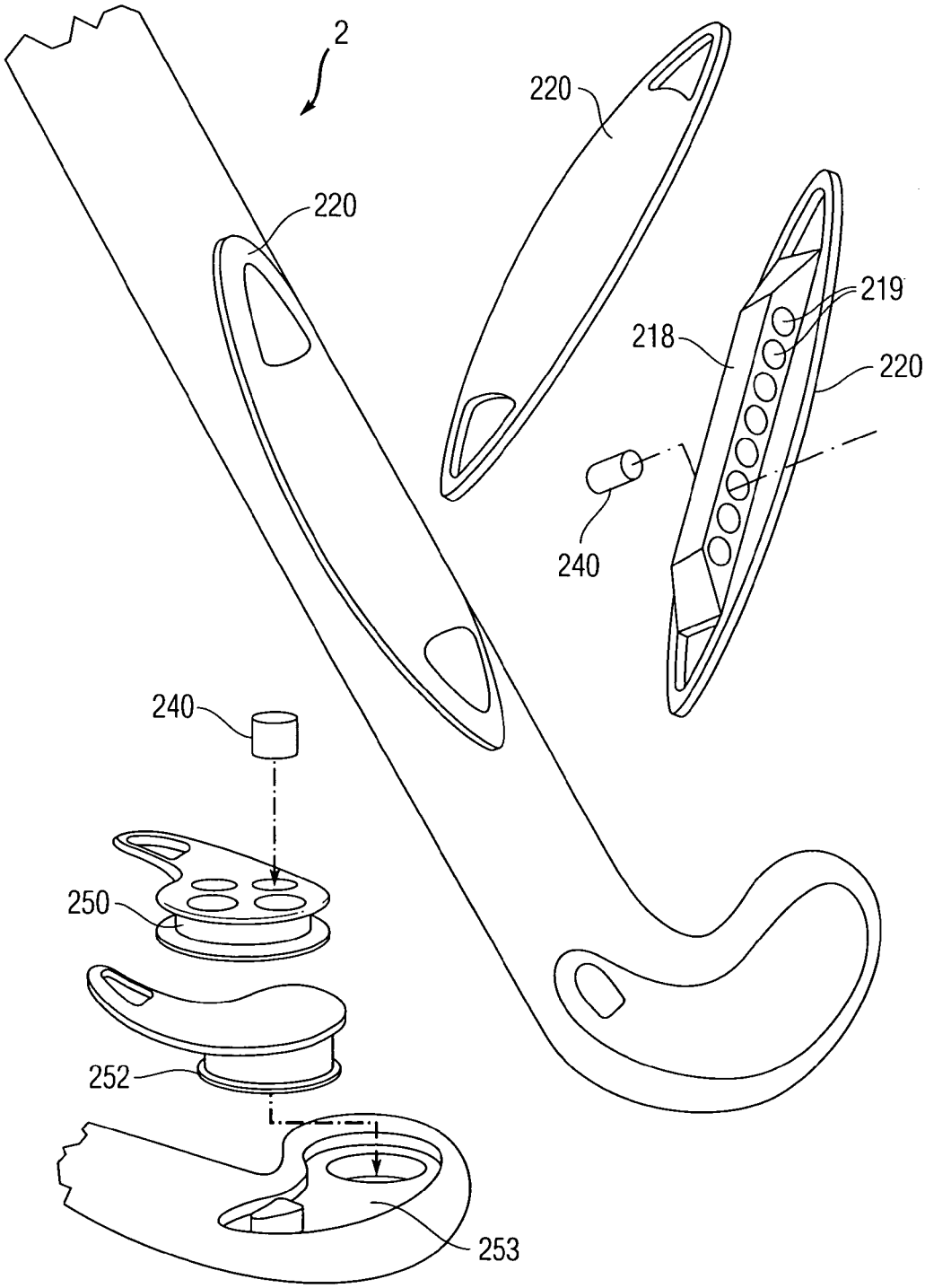
FIG. 7 is a perspective composite view of a field hockey stick with integral weighting system according to a fourth embodiment of the present invention.

FIG. 7 is a perspective composite view of a field hockey stick with integral weighting system according to a yet another embodiment of the present invention which is a variation on that of FIGS. 6A-E. In this embodiment flexible weight tray 220 is further formed with an inwardly protruding rib 218 defined by a plurality of evenly-spaced coaxial cylindrical apertures or receptacles 219 each designed to receive one weight 240 that can be inserted or removed from the apertures by friction fit at various points along the tray's length. The weights are likewise truncated cylinders, and may be made of high density polymer material at a weight of approximately ten (10) grams each, as above. The distal weight tray 250 at the toe of the stick is formed as an irregular curvilinear insert with annular plug insertable into the pocket and held captive therein by an annular rib 252 or by other means known or described herein. The annular plug is likewise defined by a plurality of receptacles for receiving weights 240 and holding them captive.

In use, a player may remove the weight trays 20, 50, 220, 250 from their respective pockets/channel and manually insert, remove, or reposition weights 40 along the length of the trays 20, 220 or in trays 50, 250 to conveniently and controllably change the weight, balance point, and feel of the field hockey stick as often as desired. For example, a player who likes a head-heavy stick or who is playing on a slower grass surface can add more weight(s) 40 towards the head section and remove weight(s) 40 from the middle of the stick to create a head heavy stick for more forceful passes and shots. Significantly, players can for the first time change the weight and balance point of their sticks for play on different surfaces. The weighting can be changed by the player before or even during a game as desired. Moreover, neither U.S. nor international game rules for field hockey preclude a weighting system according to the present invention.

Figure 8:
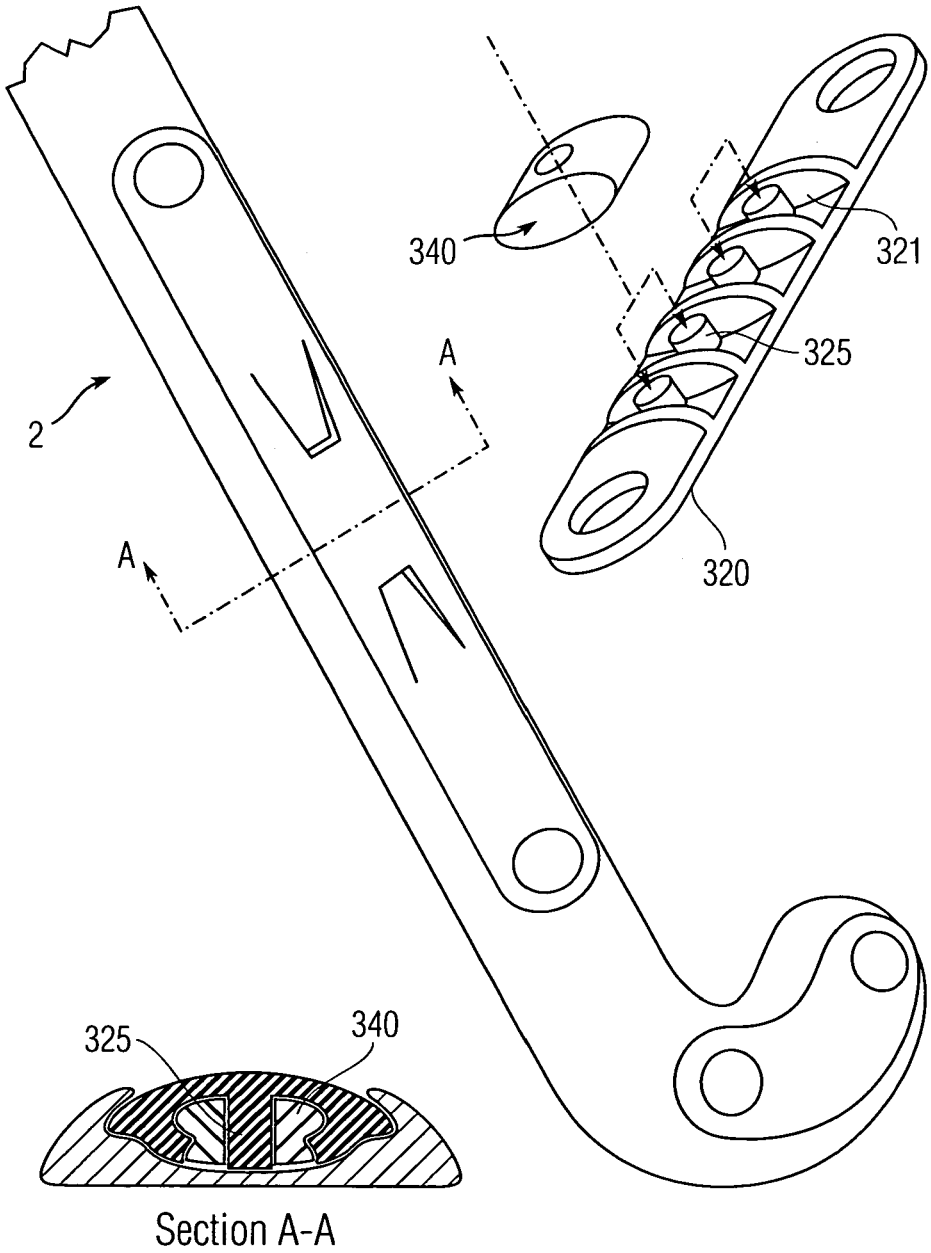
FIG. 8 is a perspective composite view of a field hockey stick with integral weighting system according to an fifth embodiment of the present invention.

FIG. 8 is a perspective composite view of yet another embodiment in which the flexible weight tray 320 is formed with inward pockets 321 each designed to receive one weight 340. Each pocket 321 is defined by a central detent post 325 onto which weights 340 may be snapped into position and seated in the pockets 321 of weight tray 320. The weight tray 320 is then inserted into the stick with the desired weights contained and distributed therein. A distal weight tray at the toe of the stick may be formed in a like manner.

Figure 9:
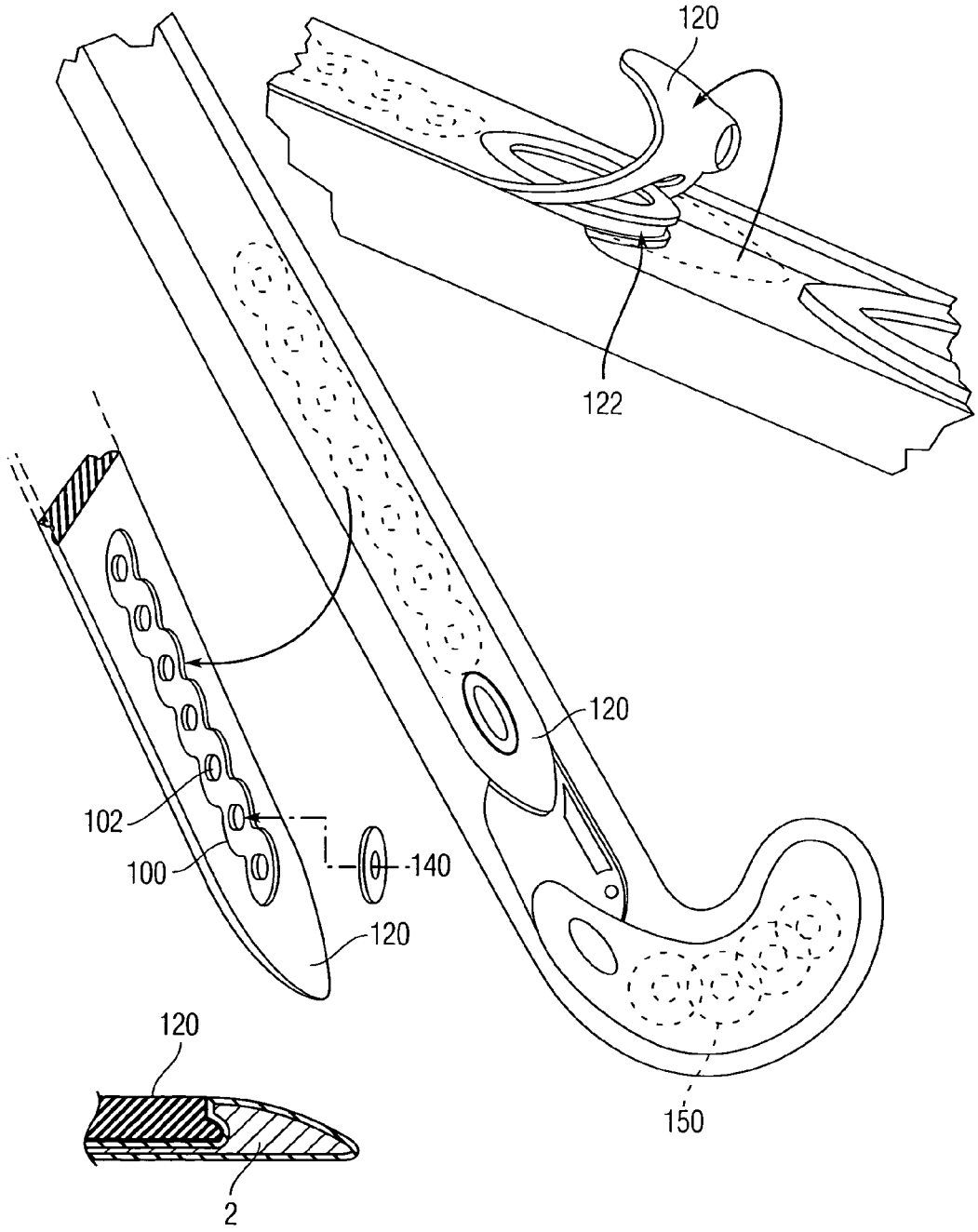
FIG. 9 is a perspective composite view of a field hockey stick with integral weighting system according to a sixth embodiment of the present invention.

FIG. 9 is a perspective composite view of a field hockey stick with integral weighting system according to yet another embodiment of the present invention. In this embodiment, the recessed channel 100 is formed as a series of annular merged pockets each having a center post 102 formed therein. Washer-shaped weights 140 may be selectively inserted onto each center post 102 at as desired along the channel 100 length. A flexible weight cover 120 formed of rubber, TPU, or other suitable malleable material is then secured within the recessed channel 100 overtop the weights 140. The weight cover is secured to the stick by friction and/or tongue-and-groove fit in the channel 100. The weight cover 120 may further be secured endwise by stretching and looping the ends over posts 122 formed on the stick. As in FIG. 6, the weight cover 120 may also be formed translucent or with outwardly-facing apertures (not pictured) that serve as windows into each receptacle 30 to allow a player to view exactly where weights 140 are inserted along the channel 100 length.

Again, an additional pocket, weights, and cover 150 may be provided at the toe of the stick to add weight thereto, preferably in a non-contact position on the toe so as not to interfere with ball contact. As above, a player may unhitch or otherwise detach and remove the weight cover(s) 120, manually insert, remove or reposition weights 140 along the length of the channel 100, and replace the weight cover(s) to conveniently and controllably change the weight, balance point, and feel of the field hockey stick as often as desired.

Figure 10:
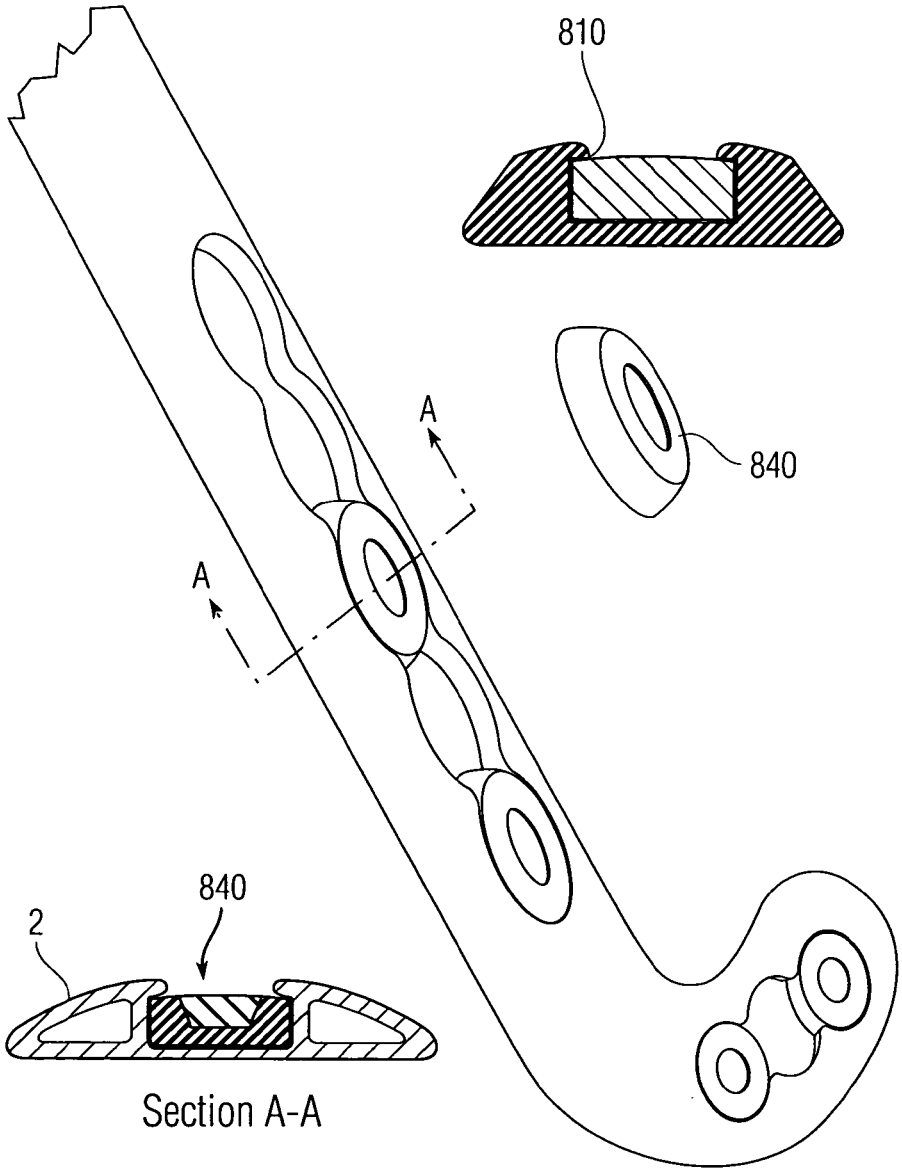
FIG. 10 is a perspective composite view of a field hockey stick with integral weighting system according to a seventh embodiment of the present invention.

FIG. 10 is a perspective composite view of yet another embodiment wherein the recessed channel 810 is formed as a series of merged pockets. Individual weight pucks 840 having various weight cores covered by a resilient high friction surface material such as silicon rubber are formed to be press-fit into the recessed pockets to alter the weight and balance of the stick.

Figure 11:
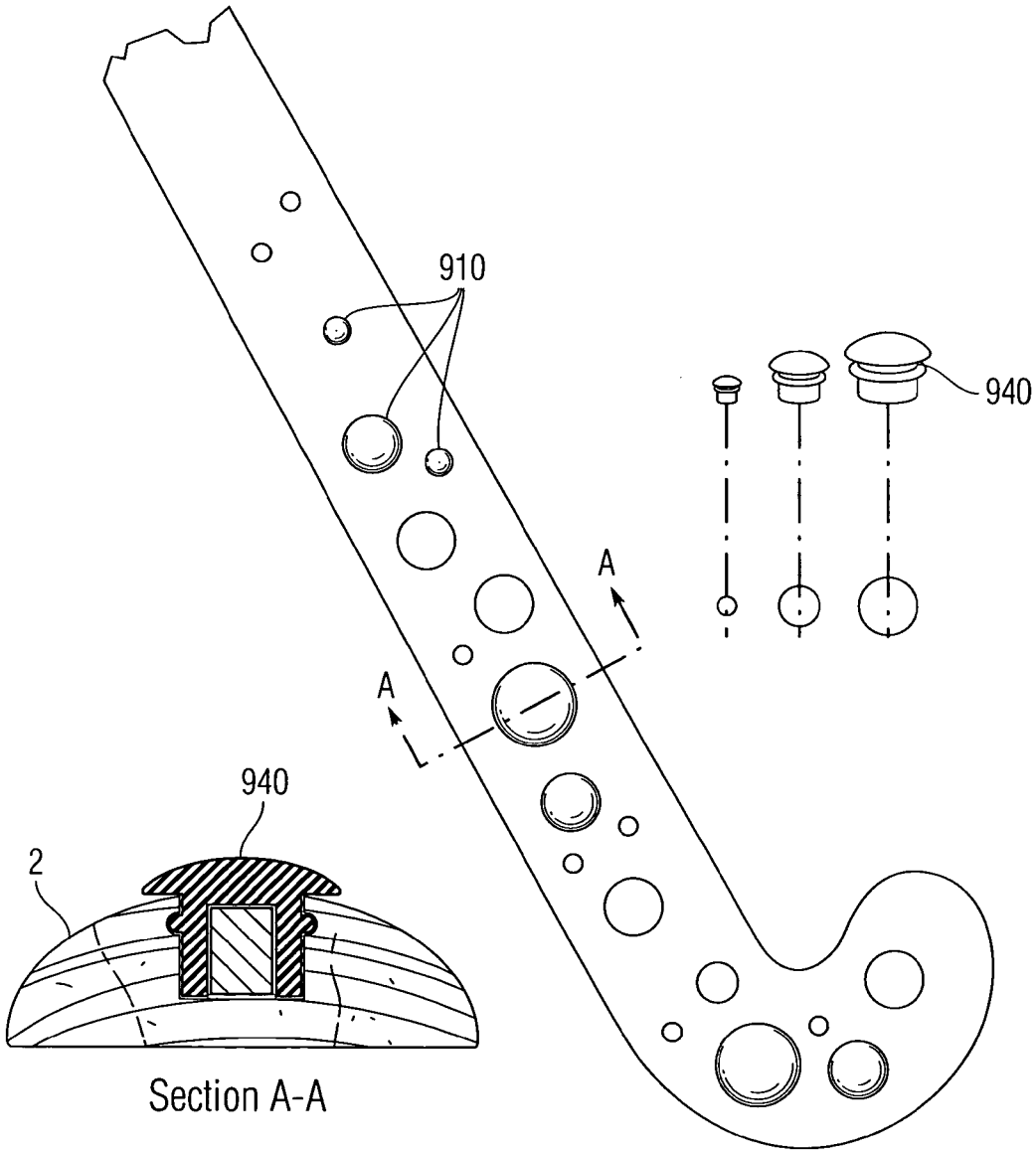
FIG. 11 is a perspective composite view of a field hockey stick with integral weighting system according to an eighth embodiment of the present invention.

FIG. 11 is a perspective composite view of another embodiment similar to FIG. 10 except that the pockets are 910 are not merged but irregularly-spaced along the stick. Different size (weight) plugs 940 and correspondingly sized holes 910 may be provided. The mixed array and placement of the plugs/holes allows a fully customizable weighting.

Figure 12:
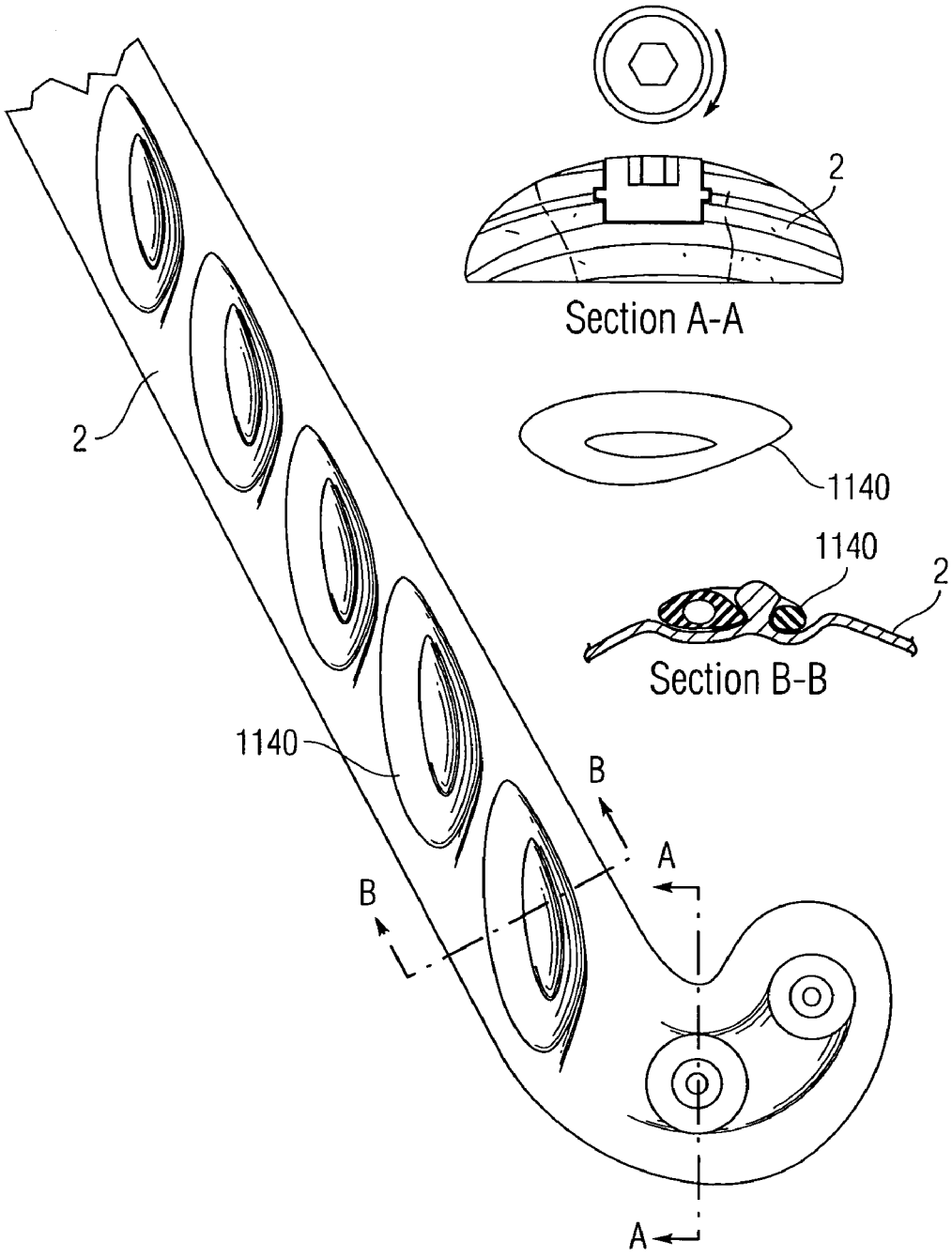
FIG. 12 is a perspective composite view of a field hockey stick with integral weighting system according to a ninth embodiment of the present invention.

FIG. 12 is a perspective composite view of an embodiment similar to FIG. 10 except that the weights pucks are formed as weight rings 1140 having flexible resilient high friction surface material such as silicon and an internally embedded weight core. Weight rings 1140 are secured to the surface of the stick 2 by posts 1141.

Figure 13:
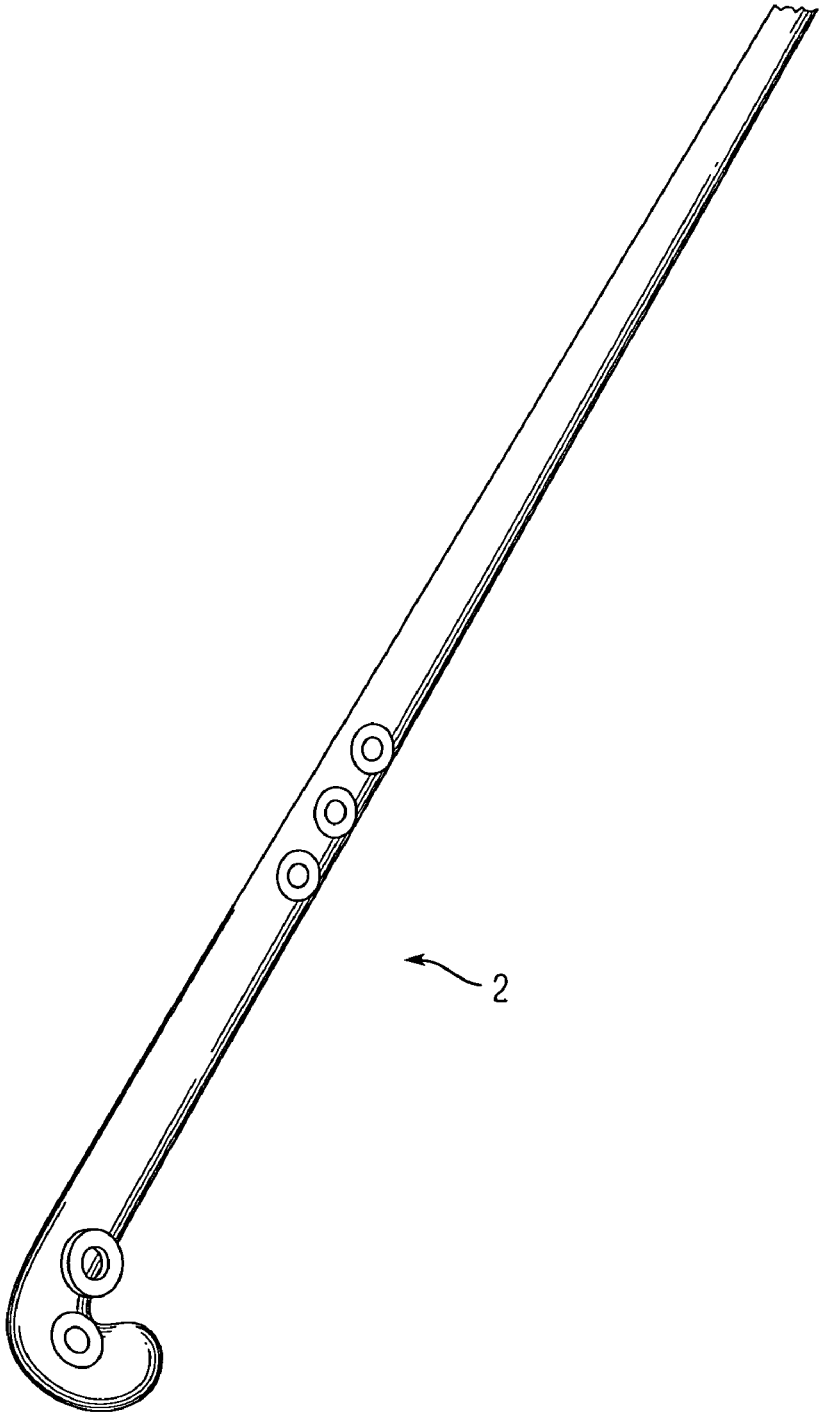
FIG. 13 is a perspective view of a fully assembled stick with integral weighting system as in FIG. 12.

FIG. 13 shows a fully assembled stick with integral weighting system as in FIG. 12.

Figure 14:
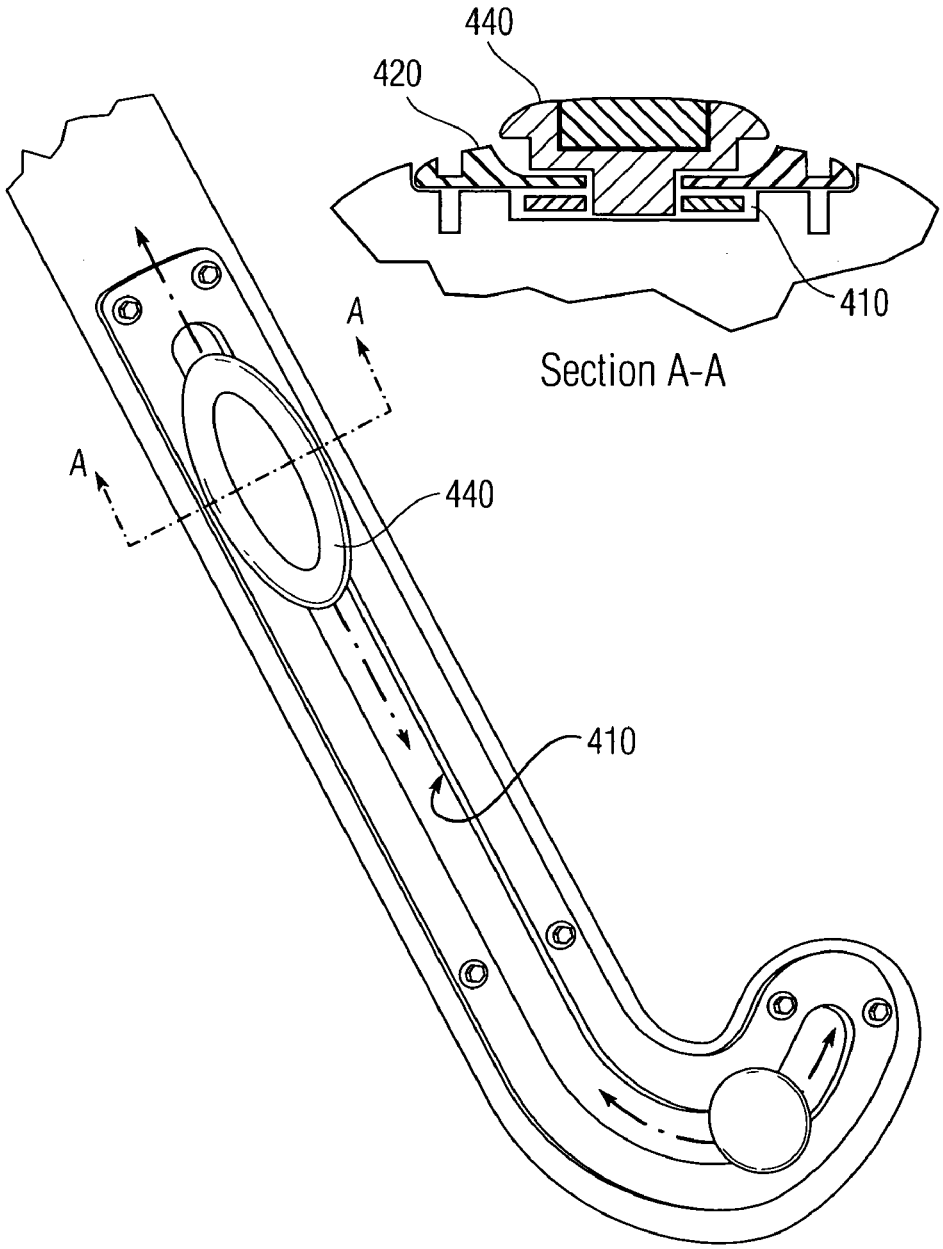
FIG. 14 is a perspective composite view of a field hockey stick with integral weighting system according to a tenth embodiment of the present invention.

FIG. 14 is a perspective composite view of yet another embodiment in which one or more sliding weights 440 may be moved lengthwise along the flexible weight tray 420. The flexible weight tray 420 is defined by an elongate slot, and each weight 440 includes a protruding flange by which it is held captive in the slot. Again the weight tray 420 fits within a recessed channel 410 extending along the length and toe of the stick.

Figure 15:
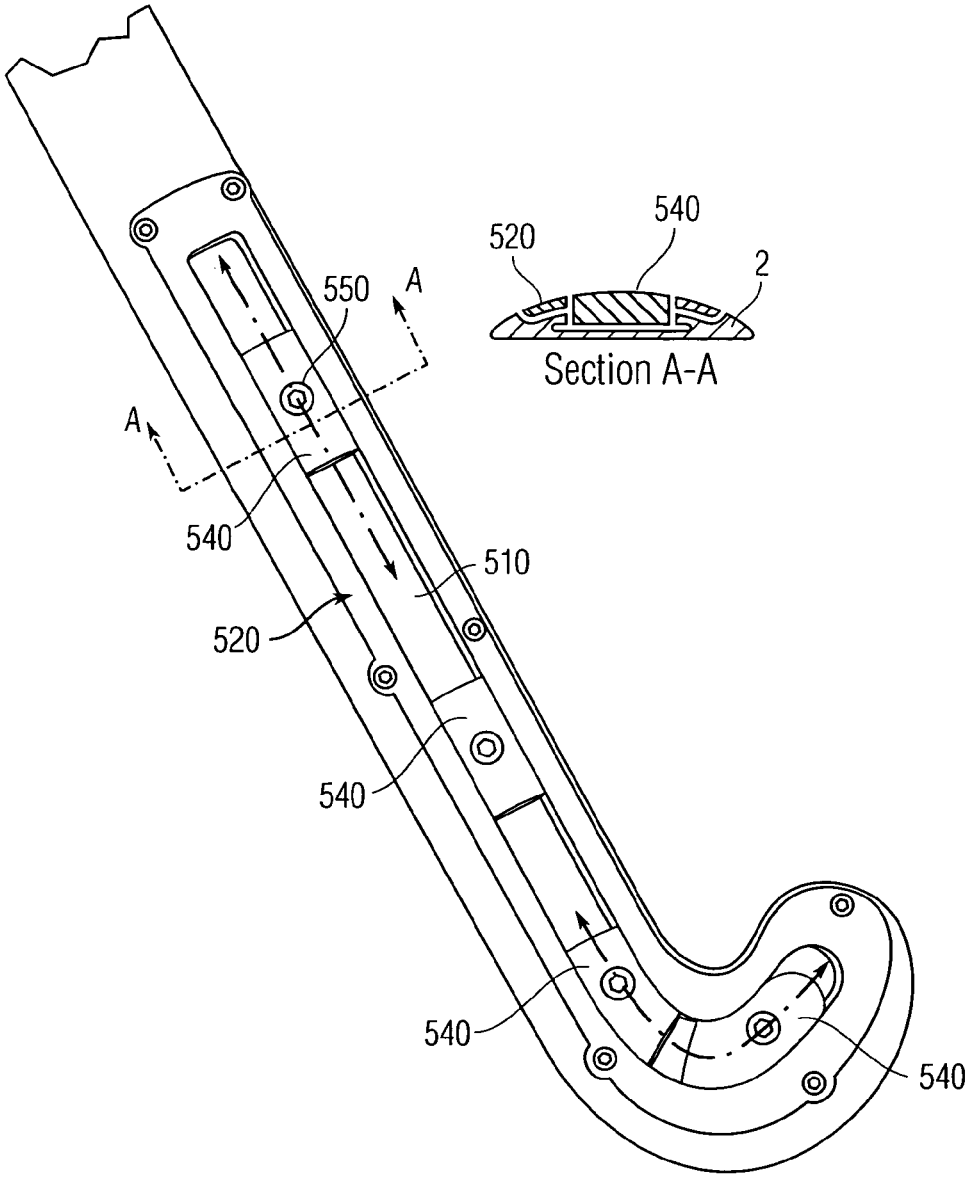
FIG. 15 is a perspective composite view of a field hockey stick with integral weighting system according to a eleventh embodiment of the present invention.

FIG. 15 is a perspective composite view of yet another embodiment similar to FIG. 14 except that the flexible weight tray is replaced by a hard shell frame 520. The sliding weights 540 are first inserted into the elongate slot 510, and the frame 520 attached there over to hold the weights 540 in the slot 510. The weights may be individually fixed in position by integral set screws 550. Note that the lower weights 540 toward the toe and the slot 510 may be accurately-shaped to allow movement of the weights 540 about a constant radius.

Figure 16:
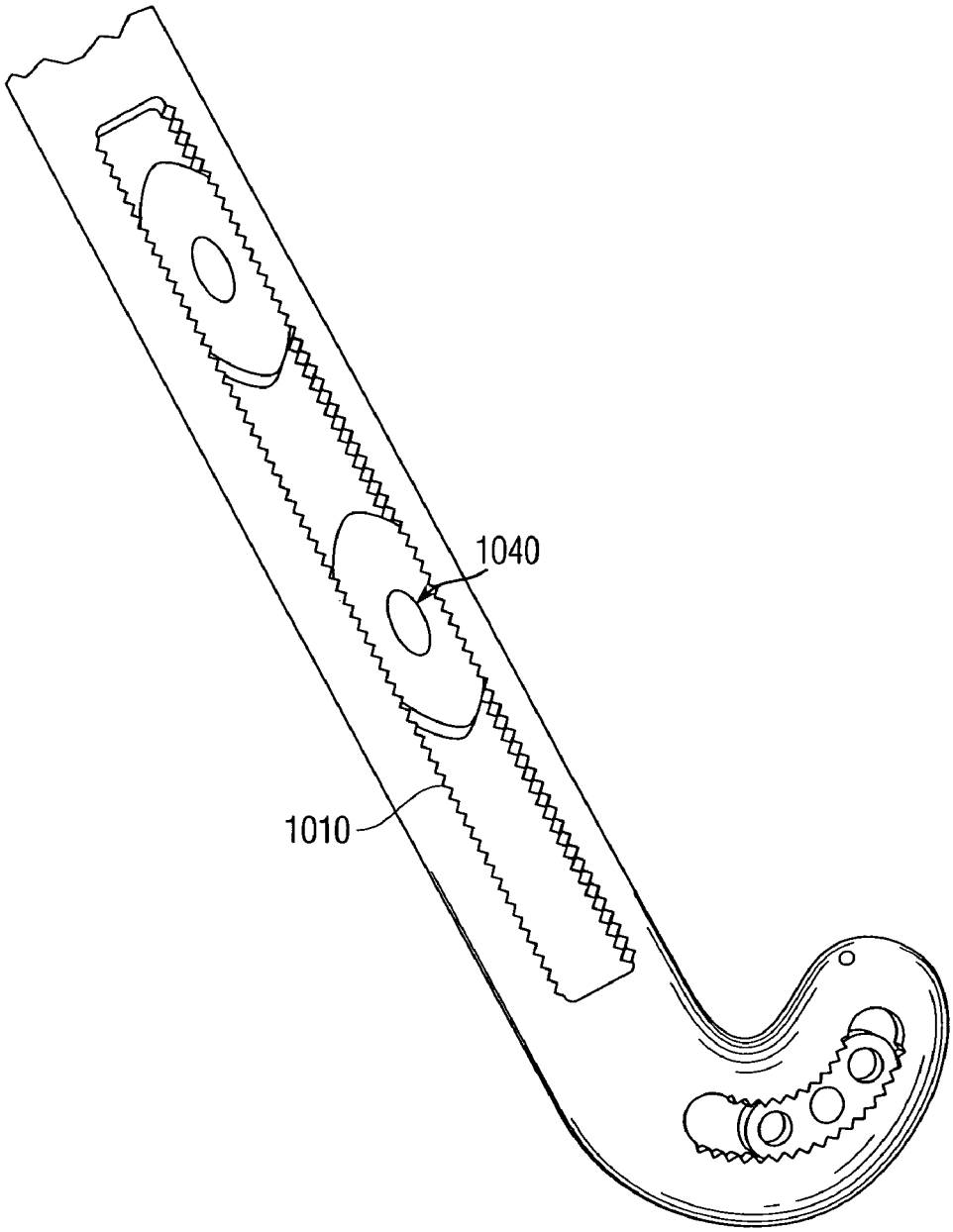
FIG. 16 is a perspective composite view of a field hockey stick with integral weighting system according to a twelfth embodiment of the present invention.

FIG. 16 is a perspective composite view of yet another embodiment similar to FIG. 14 except that the recessed slot 1010 is formed with serrated edges to allow slidable ratcheting adjustment of the position of the weights 1040.

Figure 17:
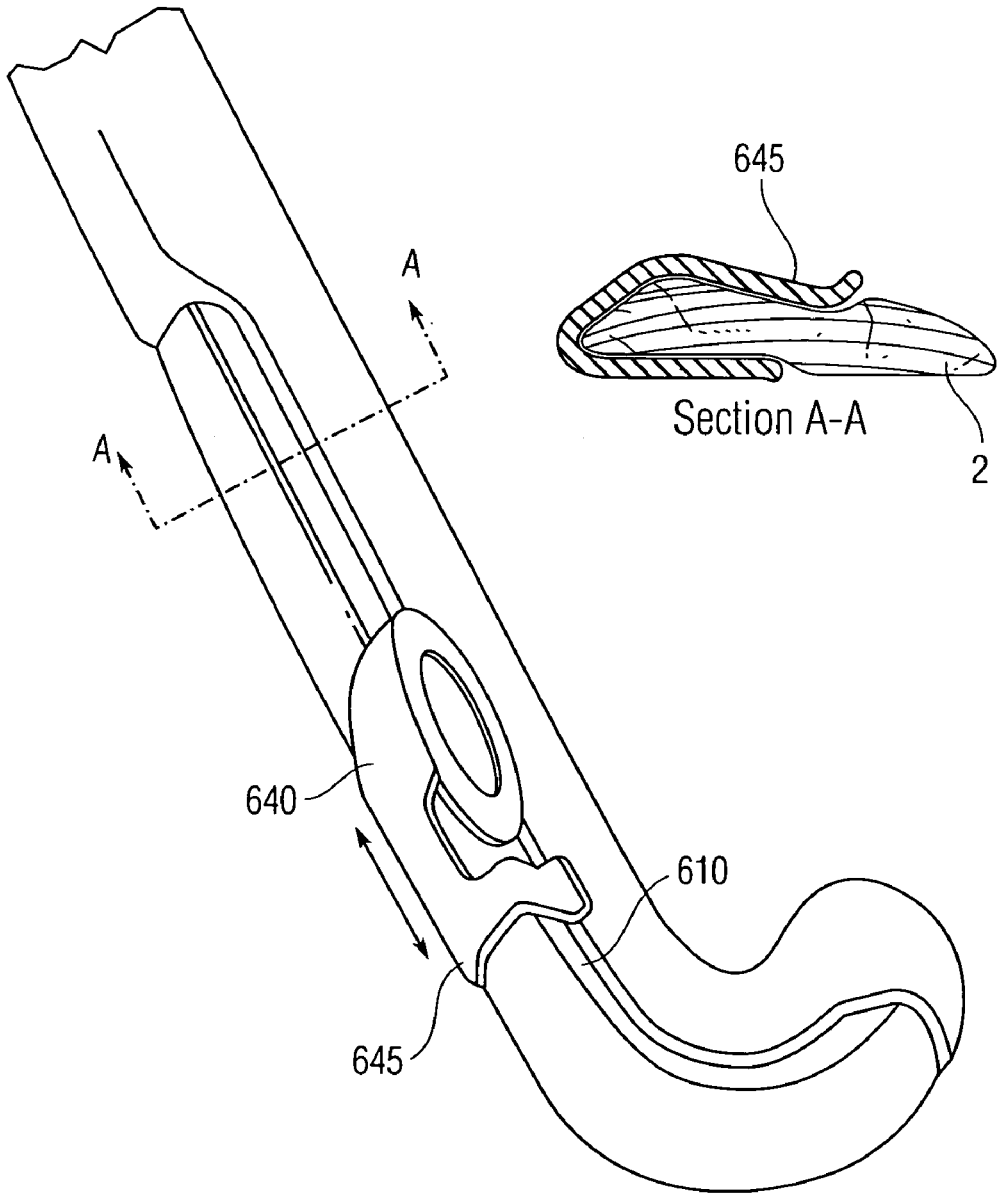
FIG. 17 is a perspective composite view of a field hockey stick with integral weighting system according to a thirteenth embodiment of the present invention.
Figure 18:
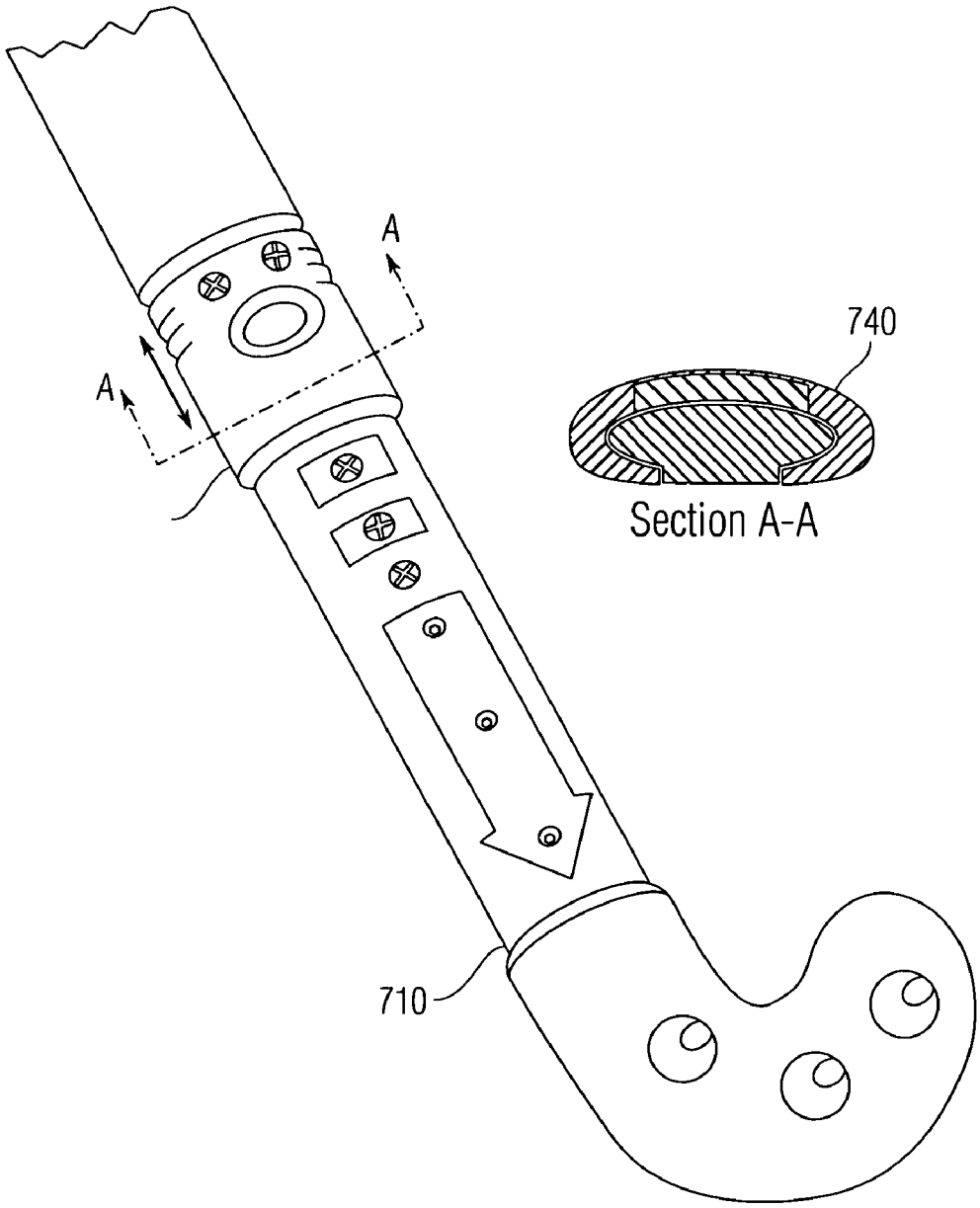
FIG. 18 is a perspective composite view of a field hockey stick with integral weighting system according to a fourteenth embodiment of the present invention.

FIG. 17 is a perspective composite view of yet another embodiment that employs a weight 640 having an integral spring clip 645 that slidably engages the surface of the stick. The weight assembly is preferably of a concave or "C" shaped to "grip" the surface of the stick although it need not be smoothly curved and in fact may be irregular and/or rectilinear so long as it defines a partially enclosed, convex portion in which to engage the stick (see sections A-A in FIGS. 17 and 18). A spring clip integral to the weight may engage a slot 610 to selectively release the weight for sliding along the longitudinal axis of the stick without releasing it for movement in an other direction. When not released by the player the spring clip 645 maintains the weight 640 in the desired position on the stick. A slot may be provided in a surface of the stick as described but is not required and spring clip 645 may directly engage the surface of the stick. The concave form of the weight may partially grip cross section of the stick by engaging the slot or may fully or partially encircle the entire circumference of the stick, as in FIG. 18. FIG. 18 is a perspective composite view of yet another embodiment that employs one or more weights 740 formed as a collar to encircle the stick. The weight collar 740 may be slideable positioned within a slightly recessed slot 710 or may encircle the stick without a recess. The weight 740 may be set in position by set screws, cam locks, or the like.

One skilled in the art should now understand that all the above-described embodiments comprise an integral weighting system especially suited for a field hockey stick that allows a player to freely adjust the weight and balance point of the stick, thereby adapting it to suit personal preference for play on different surfaces or in different conditions.

Having now fully set forth the preferred embodiment and certain modifications of the concept underlying the present invention, various other embodiments as well as certain variations, modifications and combinations of the embodiments herein shown and described will obviously occur to those skilled in the art upon becoming familiar with said underlying concept. For example, a stick may be manufactured with one of the disclosed variable weighting systems in the handle portion of the stick with another of the disclosed systems in the head portion of the stick. Further, the stick can be manufactured with female, threaded recesses at specified points along the stick from the grip to the toe section, and the weights made as male, threaded plugs to be screwed into points along the back of the stick. The weights can be inserted into the channel or holes and secured in place by any of a pressure fit, a clip, teeth, or any other commonly accepted means of attachment. The weights can be fixed position or slidable along the length of the channel before being fixed in position. It is to be understood, therefore, that the invention may be practiced otherwise than as specifically set forth in the appended claims.

I claim:

1. A weighting system in combination with a sports stick, said sports stick having a head and a substantially linear handle, said head and handle characterized by a front surface and a back surface, said weighing system comprising:

a channel formed along said sports stick and defined by a bottom, a maximum width, and a top forming a slit extending lengthwise along said sports stick, said maximum width being greater than a width of said slit; and a weight assembly movably affixed within said channel to allow a player to freely adjust the weight and balance point of the stick to preference, said weight assembly further comprising, a body in said channel, a weight portion contained within said body, at least one high friction surface on said body selectively engaging said top surface of said channel to prevent said weight assembly from sliding in said channel, at least one resilient projection on said body slideably engaging said bottom surface of said channel to advance said at least one high friction surface against said top surface, a dorsal member extending from said body through said slit whereby external force applied to said dorsal member deforms said resilient projections to disengage said at least one high friction surface from said top surface to permit sliding of said weight assembly in said channel, said at least one resilient projection returning to its original form to reengage said at least one high friction surface with said top surface on removal of said external force.

2. The weighting system for a sports stick according to claim 1 wherein said at least one resilient projection comprises a plurality of ribs that deform by elastic bending under application of said external force.

3. The weighting system for a sports stick according to claim 1 wherein said at least one resilient projection comprises a plurality of protrusions that compress elastically under application of said external force.

4. The weighting system for a sports stick according to claim 1 wherein said weight assembly is further comprised of a grip affixed to said resilient member, said grip further comprising at least one high friction surface drawn against an external surface of said sports stick by force of said resilient member to prevent said weight portion from sliding in said channel, said at least one high friction surface being disengaged from said external surface of said sports stick by application of external force to strain said resilient member thereby permitting said weight assembly to slide, said at least one high friction surface reengaging said external surface by force of said resilient member on removal of said external force.

* * * * *